US008129641B2

(12) United States Patent
Majewski et al.

(10) Patent No.: US 8,129,641 B2
(45) Date of Patent: Mar. 6, 2012

(54) INSTALLATION SWITCHGEAR HAVING A SPRING-LOADED TERMINAL ARRANGEMENT

(75) Inventors: Joachim Majewski, Dossenheim (DE); Roland Ritz, Dielheim (DE); Klaus-Peter Eppe, Waldbrunn (DE)

(73) Assignee: ABB AG, Mannheim (DE)

( * ) Notice: Subject to any disclaimer, the term of this patent is extended or adjusted under 35 U.S.C. 154(b) by 180 days.

(21) Appl. No.: 12/596,192

(22) PCT Filed: Apr. 14, 2008

(86) PCT No.: PCT/EP2008/002938

§ 371 (c)(1), (2), (4) Date: Oct. 16, 2009

(87) PCT Pub. No.: WO2008/128668

PCT Pub. Date: Oct. 30, 2008

(65) Prior Publication Data

US 2010/0116634 A1 May 13, 2010

(30) Foreign Application Priority Data

Apr. 21, 2007 (DE) ..... 10 2007 018 960
Apr. 7, 2008 (DE) ..... 10 2008 017 738

(51) Int. Cl.
*H01H 3/04* (2006.01)

(52) U.S. Cl. ..... 200/335; 439/441; 439/835

(58) Field of Classification Search ..... 200/355; 439/441, 835, 864, 725, 157
See application file for complete search history.

(56) References Cited

U.S. PATENT DOCUMENTS

| | | | | |
|---|---|---|---|---|
| 4,759,726 | A * | 7/1988 | Naylor et al. | 439/441 |
| 5,515,574 | A * | 5/1996 | Larson | 16/429 |
| 6,004,168 | A * | 12/1999 | Fuchs et al. | 439/835 |
| 6,019,647 | A * | 2/2000 | Trudel et al. | 439/864 |
| 6,056,582 | A * | 5/2000 | Okabe | 439/372 |
| 6,341,989 | B1 | 1/2002 | Jaag | |
| 6,689,955 | B2 | 2/2004 | Doutaz | |

FOREIGN PATENT DOCUMENTS

| | | |
|---|---|---|
| EP | 1213791 A1 | 6/2002 |
| EP | 1296413 A1 | 3/2003 |

OTHER PUBLICATIONS

International Search Report for PCT/EP2008/002938, mailed Jul. 9, 2008.

* cited by examiner

*Primary Examiner* — Xuong Chung Trans
(74) *Attorney, Agent, or Firm* — Leydig, Voit & Mayer, Ltd.

(57) ABSTRACT

An installation switching device includes a housing having a terminal connecting area and a screwless spring-loaded terminal fixed in position in the terminal connecting area, and a spring operating lever. The screwless spring-loaded terminal includes a clamping spring having a contact limb, a clamping limb having a clamping window with a clamping edge, and a curved spring rear connecting the contact and clamping limbs and configured to interact with a mount part surrounding a clamping strip, such that a connecting conductor is clampable between a rear face of the clamping strip and the clamping edge.

11 Claims, 6 Drawing Sheets

INSTALLATION SWITCHGEAR HAVING A SPRING-LOADED TERMINAL ARRANGEMENT

This is a U.S. National Phase Application under 35 U.S.C. §171 of International Application No. PCT/EP2008/002938, filed on Apr. 14, 2008, which claims priority to German Application No. DE 10 2007 018 960.7, filed on Apr. 21, 2007 and German Application No. DE 10 2008 017 738.5, filed on Apr. 7, 2008. The International Application was published in German on Oct. 30, 2008 as WO 2008/128668 under PCT article 21 (2).

The invention relates to an installation switching device having a spring-loaded terminal arrangement.

BACKGROUND

By way of example, installation switching devices of this generic type may be circuit breakers, residual current devices, motor protective switches or selective main line circuit breakers. A tool by means of which pressure is exerted on the spring leaf is normally required in order to open the spring-loaded terminal. Although the spring-loaded terminal arrangement is then itself of very simple design, an additional control opening must, however, be provided in the housing of the installation switching device, and handling is complicated because of the tool which is required for insertion and removal of the connecting conductor.

In order to allow a connecting conductor to be connected to, and removed again from, spring-loaded terminals of this generic type without a tool, it is necessary for the spring-loaded terminal arrangement to have a spring operating means which an operator can use to open the spring-loaded terminal when required, by pushing on the spring leaf. The terminal is closed automatically because of the resetting spring force of the spring leaf, when the pressure is removed from the spring leaf.

EP 1 213 791 B1 discloses a spring-loaded terminal arrangement which has an operating lever for the spring leaf, having a spring leaf of the cage type which forms a loop with a triangular profile at the rounded angles, with the two end sections being aligned precisely at right angles to one another, and having an electrically conductive terminal to which the first end section of the spring leaf is fitted, and with an opening passing through the leaf. The operating lever for the leaf is mechanically connected to the terminal, and guide means for the operating lever are fitted to the terminal. The guide means make it possible to keep the lever in constant contact with the spring leaf. When no pressure is applied to the spring leaf, the lever rests on the culmination section of the spring leaf.

In this case, the advantage of operability without the use of tools is obtained at the expense of the disadvantage of complicated design of the spring terminal arrangement.

SUMMARY OF THE INVENTION

An aspect of the present invention is therefore to provide an installation switching device of this generic type in which a connecting conductor can be inserted and removed without any tools, by means of a conventional spring-loaded terminal arrangement of simple design.

Thus, according to the invention, a spring operating lever which can be operated from outside the housing is connected to the housing such that it can pivot and has a bending arm which presses on the spring rear during pivoting from a rest position to an open position such that the clamping window releases a clamping opening on the rear face of the clamping strip for insertion of the connecting conductor.

An installation switching device according to the invention has the advantage that the spring operating means is disconnected from the terminal and is mounted in the housing. The terminal itself can therefore be of very simple design. The respectively simplest option, which can be installed best, can be chosen for the arrangement of the spring operating means in the housing.

According to one advantageous embodiment of the invention, the spring operating lever is a double-armed lever having an operating arm, which projects out of the housing, and a bending arm, which is guided in the interior of the housing. This can be made of plastic, and therefore at very low cost. By way of example, the mounting in the housing may be in the form of a shaft which is connected to the housing in a fixed position. The shaft can also be provided by integrally forming in each case one pin on each side at the point of rotation of the double-armed lever, which pin is mounted such that it can pivot in a respectively corresponding recess in the inside of the housing.

According to a further advantageous embodiment, the spring operating lever is fitted such that it remains in its open position by self-locking therein until it is pivoted back to the rest position by hand. For this purpose, the bending arm is advantageously fitted at its free end with a contact surface which is in the form of a cam by means of which it rolls on the spring rear, pressing it, during operation in the opening direction, thus resulting in a continuous opening process and in self-locking of the spring operating lever by a form of latching in the end position of the open position.

An embodiment in which the operating arm is formed from two parts, in the form of two arm elements which are pushed one inside the other, is highly advantageous. The operating arm can thus be lengthened by pulling out the second arm element, thus making it possible to achieve a greater lever force during pivoting.

In order to ensure guidance of the spring operating lever in the installation switching device, in one particularly advantageous embodiment, a first guide means can be fitted to the spring operating lever and a second guide means can be fitted in the interior of the housing shells, which guide means interact for guidance of the spring operating lever. The clamping spring itself has no guide means and is therefore of very simple design.

According to a further advantageous embodiment, a locking device can be fitted in the interior of the housing shells and is able to interact with the first guide means of the spring operating lever in the open position, so as to prevent inadvertent pivoting of the spring operating lever from the open position to the rest position. This offers a redundant capability, in addition to the self-locking already mentioned above, of preventing inadvertent pivoting of the spring operating lever from the open position to the rest position.

The spring operating lever is advantageously arranged such that, in the rest position, it projects such that it is flush with the rearward front face of the housing and at right angles to the associated narrow face, and, in the open position, is pivoted toward the forward front face such that, in the open position, it projects at right angles to the rearward front face and such that it is approximately flush with the associated narrow face.

According to a further advantageous embodiment, the second guide means is a curved groove and the first guide means is a guide pin on the spring operating lever.

A locking contour can be fitted to the housing inner face in the area in which the guide pin is located when the spring operating lever is located in the open position, and the spring operating lever can then be movable in the direction of the locking contour when in the open position, such that the guide pin is coupled to the locking contour and thus prevents inadvertent pivoting of the spring operating lever from the open position to the rest position.

In this case, the locking contour may advantageously be a web, which projects on the inner wall of the housing, or an undercut.

Further advantageous refinements and improvements of the invention, as well as further advantages, can be found in the dependent claims.

BRIEF DESCRIPTION OF THE DRAWINGS

The invention as well as further advantageous refinements and improvements of the invention will be explained and described in more detail with reference to the drawings, which illustrate one exemplary embodiment of the invention, and in which.

DETAILED DESCRIPTION

Figure 10:
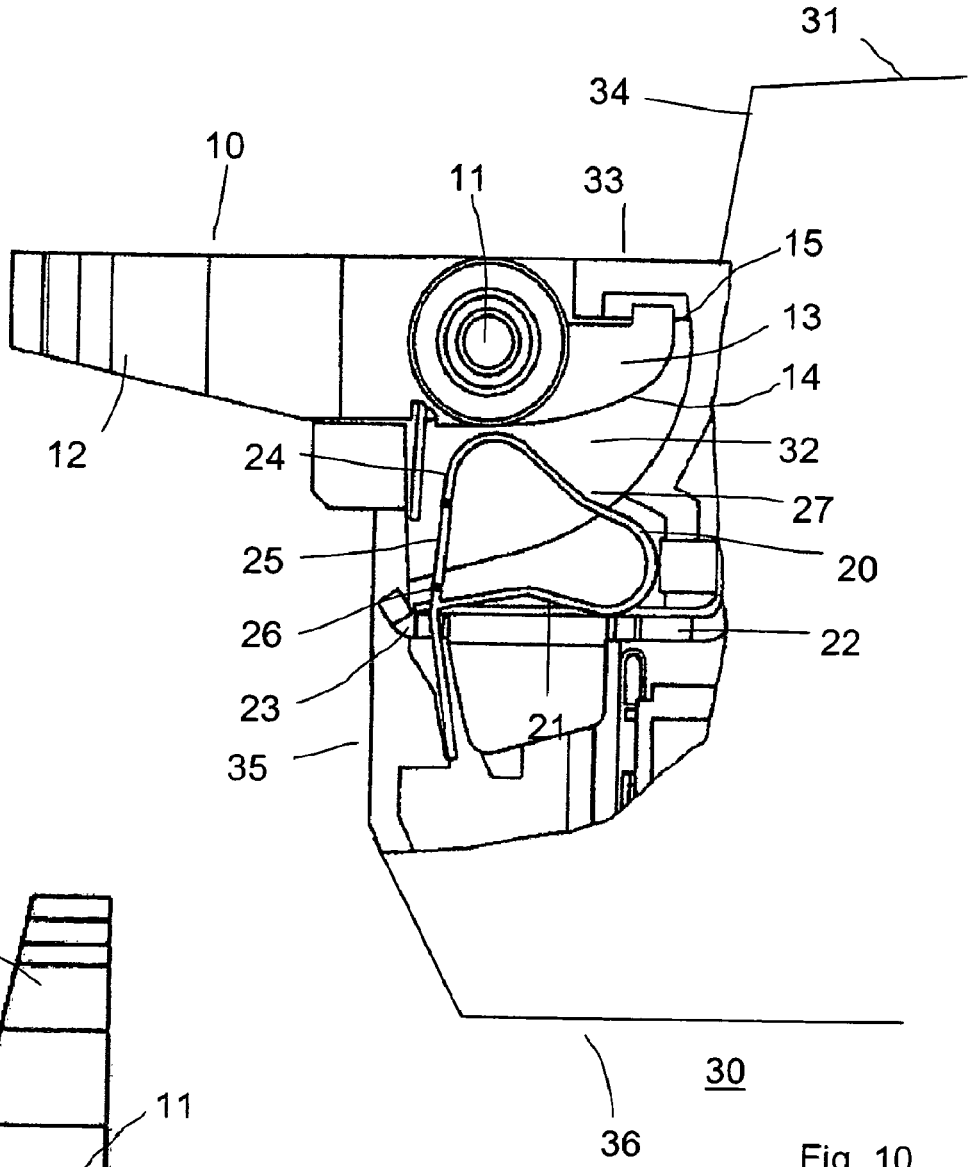
FIG. 10 shows a spring operating lever with the associated clamping spring, installed in the terminal accommodation area of an installation switching device, in the rest position.

FIG. 10 will be considered first of all. This shows a spring operating lever 10 with the associated clamping spring 20, installed in the terminal accommodation area 32 of an installation switching device 30, in the rest position. The installation switching device 30 may be a circuit breaker, a main switch, a motor protective switch or the like. Its housing is composed of insulating material, and is indicated schematically. This comprises a forward front face 31, a rearward front face 33, a forward narrow face 34, a rearward narrow face 35 and an attachment face. A broad face, which connects the front and narrow faces parallel to the plane of the drawing, is likewise provided, but is not shown in the illustration in FIG. 10. This is indicated in the perspective illustration in FIG. 5.

An installation switching device 30 is normally used to monitor and/or to switch a current path which is passed through said device between two connecting terminals. Further assemblies and elements are provided for this purpose in the interior of the installation switching device, for example at least one contact point comprising a moving contact piece and a stationary contact piece, a moving contact lever, a latching mechanism for operating the contact lever, one or more tripping assemblies, for example a thermal overcurrent release, and/or a magnetic impact-type armature system, an operating lever for manual operation from the outside, an indication apparatus for indication of the switching state, and more items of a similar kind. Attachment apparatuses may be located on the attachment face 36, by means of which the installation switching device can be fitted to mounting rails or else to busbars in installation distribution systems. The internal design and the external connecting and attachment apparatuses of an installation switching device will be assumed to be already known, for the purposes of the present invention.

The connecting terminals are in this case accommodated in terminal accommodation areas, one of which is annotated with the reference number 32 in FIG. 10. The terminal accommodation area 32 is located in the area of the rearward narrow face 35, in the vicinity of the rearward front face 33.

A clamping spring 20 is mounted in the terminal connecting area 32. The spring leaf of the clamping spring forms a loop with a triangular contour and rounded corners. The clamping spring therefore has a contact limb 21, by means of which it rests on the free end of a busbar 22 which forms the connection to the current path into the device interior. The free end 23 of the busbar 22 is in this case also referred to as a clamping strip, and the busbar 22 is also referred to as a mount part.

The clamping spring 20 also has a clamping limb 24 which runs approximately at right angles to the contact limb 21. A rectangular cutout, which is referred to as a clamping window 25, is provided in the clamping limb 24, and its lower edge forms the clamping edge 26.

Figure 11:
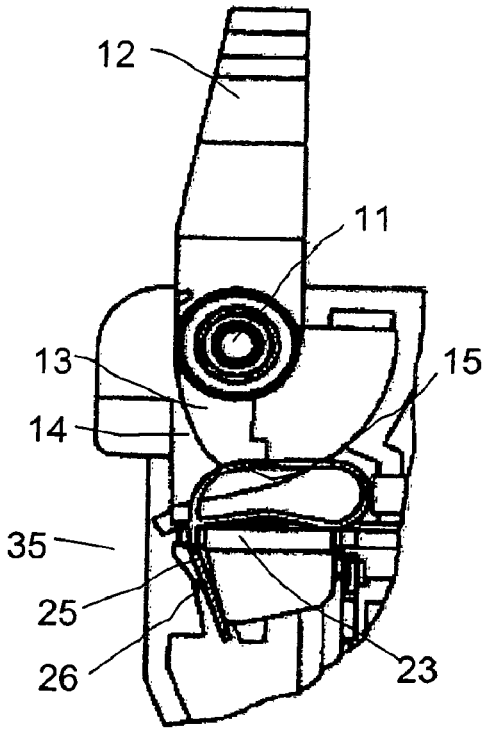
FIG. 11 shows a spring operating lever with the associated clamping spring, installed in the terminal accommodation area of an installation switching device, in the open position.

The contact limb 21 and the clamping limb 24 are connected by means of the spring rear 27. The clamping limb 24 can be pushed downward by pressure from above on the spring rear 27, that is to say toward and at right angles to the contact limb 21, as a result of which the clamping window is forced onto that side of the clamping strip which faces away from the contact limb 21. This position is illustrated in FIG. 11 which shows the clamping spring 20 in the open position. A connecting conductor can now be inserted into the clamping window 25 from the rearward narrow face 35. When the pressure is removed from the spring rear, then it moves the clamping limb 24 back again in the direction of the rest position, by virtue of its spring characteristic. In the process, the inserted connecting conductor is then firmly clamped between the clamping edge 26 and that side of the clamping strip 23 which faces away from the contact limb 21.

In order to operate the clamping spring, that is to say to apply the pressure required for opening to the spring rear, a spring operating lever 10 is fitted in the installation switching device and is mounted such that it can rotate on a shaft 11 which is coupled to the housing. The spring operating lever 10 is a double-armed lever with an operating arm 12 which projects from the housing, and with a bending arm 13 which runs in the interior of the housing. The operating arm 12 acts as a handle for operation of the clamping spring 20. The bending arm 13 causes the sprung loop to act on the spring rear 27.

In the rest position, the operating arm 12 projects at right angles to the rearward narrow face 35 and flush with the rearward front face of the housing. It therefore at the same time acts as a closure for the terminal accommodation area 32 in the area of the junction between the rearward front face 33 and the rearward narrow face 35.

At its free end, the bending arm 13 of the spring operating lever 10 is fitted with a contact surface 14 which is curved in the form of a cam. This contact surface 14 is bent away from the spring rear 27. At its end, the bending arm 13 has a flat 15.

When the spring operating lever 10 is pivoted by hand by an operator from the rest position as shown in FIG. 10 to the open position as shown in FIG. 11, about the shaft 11, then the contact surface 14 of the bending arm 13 in the process rolls on the spring rear 27, bending the latter to its open position. The rolling process results in a smooth movement during opening of the clamping spring, preventing tilting of the spring operating lever 10 with the clamping spring 20.

At the end of the opening movement, the spring operating lever 10 then projects at right angles to the rearward front face 33 in its open position, see FIG. 11. In its end position, the flat 15 on the bending arm 13 then holds the clamping spring in its open position. In this case, the flat 15 rests flat on the spring rear. The resetting force of the clamping spring acts via the flat 15 at right angles to the bearing shaft 11 of the spring operating lever. This to a certain extent ensures self-locking or latching of the spring operating lever 10 in the open position. The spring operating lever cannot fall back on its own from the open position to the rest position.

The spring operating lever 10 is thus mounted in the housing and is actually not connected to the terminal. The terminal itself does not have guide means for the spring operating lever 10, and instead the guide means for the spring operating lever 10 are provided in the interior of the housing shells. The functions of "clamping" and "operating" are thus provided in separate assemblies.

The spring operating lever 10 is formed in two parts. This will now be explained with reference to FIGS. 8, 9, 12 and 13. The spring operating lever 10 comprises a core part 101 and a casing part 102 which is pushed over the core part 101 and has an internal recess for holding the core part. The core part 101 forms a double-armed lever, one of whose arms forms the operating arm 12 of the spring operating lever 10. The other arm forms an operating projection 103, onto which the casing part 102 is pushed in the form of a screen. The casing part 102, which is pushed onto the operating projection 103, therefore forms the operating arm 12 of the spring operating lever.

The free end of the operating projection 103 is fitted with two spring arms 104, 105, which run parallel and are fitted with a respective latching tab 106, 107 at their free ends.

Figure 8:
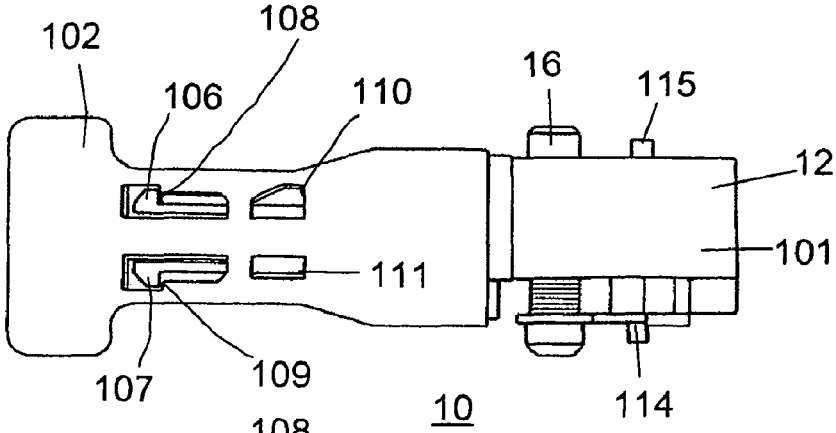
FIG. 8 shows a spring operating lever as shown in FIG. 1, viewed from underneath.
Figure 9:
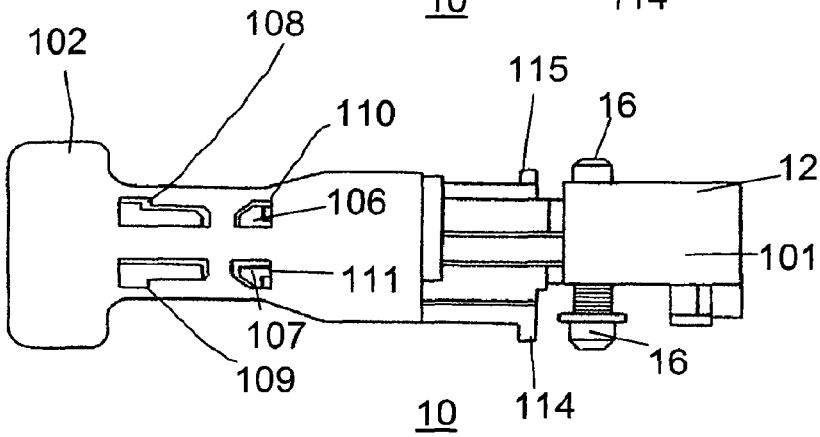
FIG. 9 shows a spring operating lever as shown in FIG. 2, viewed from underneath.
Figure 12:
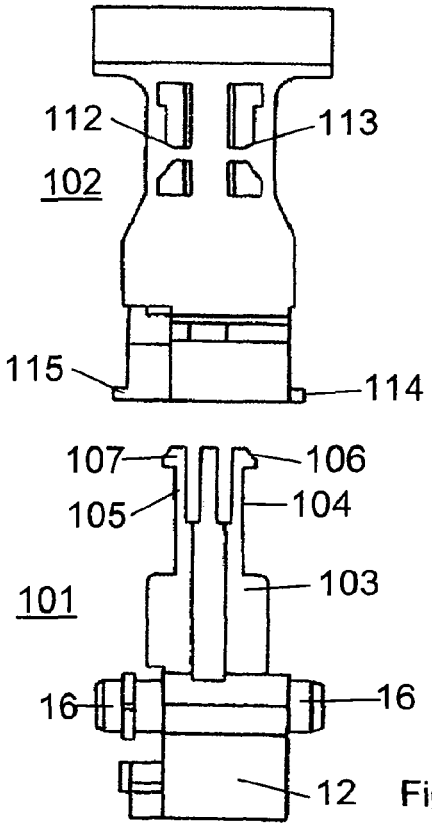
FIG. 12 shows a spring operating lever as shown in FIG. 1, in the separated state.
Figure 13:
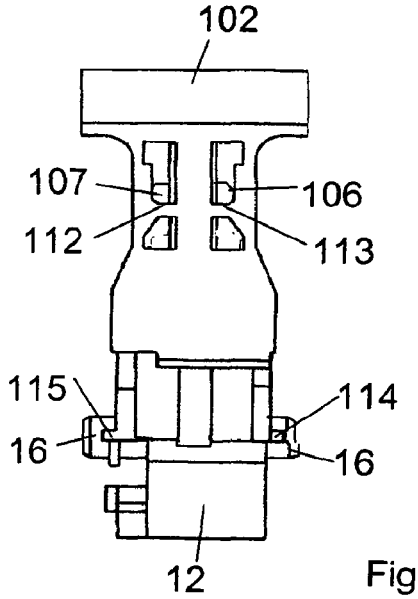
FIG. 13 shows the spring operating lever as shown in FIG. 12, in the assembled state.

After the casing part 102 has been pushed onto the core part 101, it can be moved on the latter, and in the process can assume three fixed positions. These are an inserted position as shown in FIG. 8, an extended position as shown in FIG. 9, and a mid-position as shown in FIG. 13.

First undercuts 108, 109 are located in a corresponding manner in the interior of the recess of the casing part 102, in the vicinity of the free end of the casing part, and are arranged such that they latch with the latching tabs 106, 107 in the inserted position. There are also second undercuts 110, 111 in the vicinity of that end of the casing part which faces the operating arm, and in the interior of the casing part, which undercuts 110, 111 are arranged such that they latch with the latching tabs 106, 107 in the extended position. Finally, located in-between, there are third undercuts 112, 113 which are arranged such that they latch with the latching tabs 106, 107 in the mid-position. In each of the three positions which the casing part can assume on the core part, the casing part is therefore held by the latching tabs 106, 107 latching with the corresponding undercuts.

The advantageous effect is that the effective lever arm of the operating arm is lengthened by pulling out the casing part 102, thus making it possible to achieve a greater lever force during operation of the spring.

Bearing journals 16 which project at the side are integrally formed on the core part 101 and are used for mounting the spring operating lever such that it can pivot, in depressions 17 which are incorporated at an appropriate position in the housing broad face. This allows particularly simple fitting. The spring operating lever 10 comprises only two parts, which can be produced completely as injection-molded parts, for example from plastic, and therefore at very little cost. The depressions for mounting the spring operating lever in the housing broad face are also incorporated in the housing parts while they are being injection molded. As an alternative to this, however, the spring operating lever could also be mounted by means of a bearing shaft. A bearing hole in the spring operating lever would then be pushed over the bearing shaft during assembly.

FIG. 1 once again shows the spring operating lever 10 in the inserted position, from above, as an operator would see it when in the installed state, and when looking at the rearward narrow face 35. The undercuts and the spring arms of the core part cannot be seen from this side.

Figure 1:
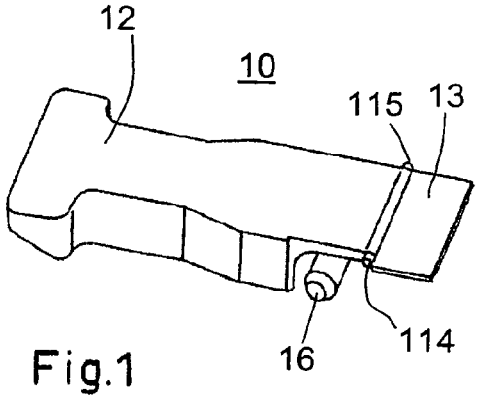
FIG. 1 shows a first embodiment of a spring operating lever according to the invention, in the retracted state.
Figure 3:
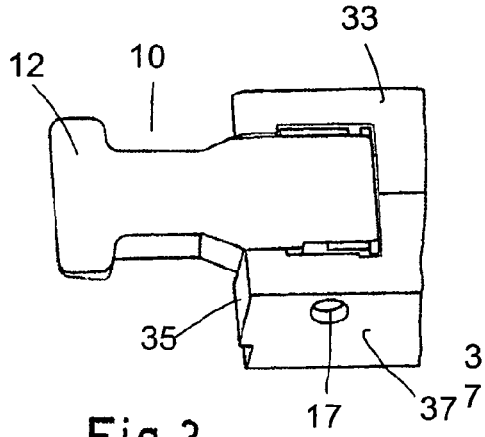
FIG. 3 shows the spring operating lever as shown in FIG. 1, in the retracted state, in its installed position in the housing.

FIG. 3 shows the spring operating lever as shown in FIG. 1, installed in an installation switching device, in the rest position.

Figure 2:
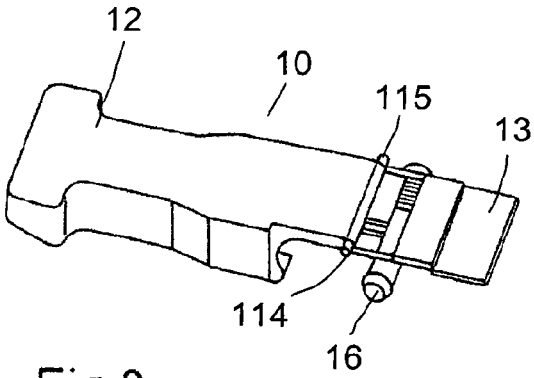
FIG. 2 shows the spring operating lever as shown in FIG. 1, in the extended state.
Figure 4:
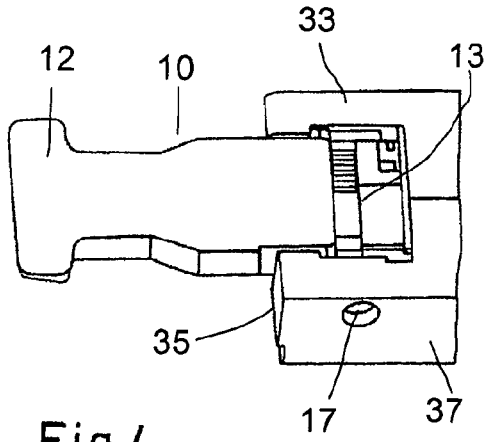
FIG. 4 shows the spring operating lever as shown in FIG. 1, in the extended state, in its installed position in the housing.

FIG. 2 shows the spring operating lever as shown in FIG. 1, in the extended position, and FIG. 4 shows the spring operating lever in the extended position, installed in an installation switching device and in the rest position.

Figure 5:
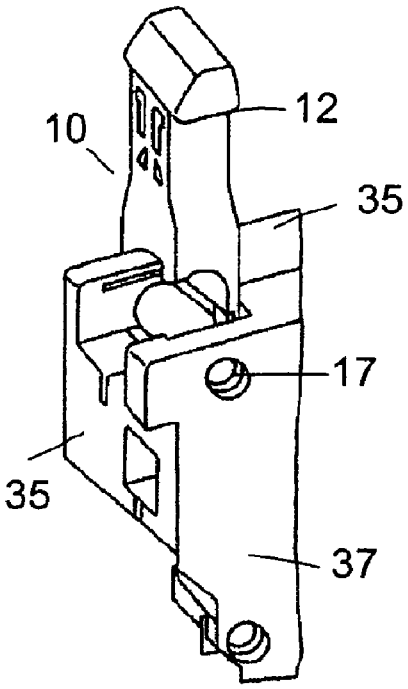
FIG. 5 shows the spring operating lever as shown in FIG. 1, illustrated in the open position, in its installed position in the housing.

FIG. 5 shows the spring operating lever as shown in FIG. 2, now installed in its open position in the housing, and pivoted upward.

Two guide pins 114, 115 are integrally formed on the casing part, close to its insertion opening for the core part, in such a way that these guide pins 114, 115 project opposite and at the side, in the axial direction. In the extended position, the guide pins 114, 115 are located between the bearing journals 16 and the free end of the operating arm 12. In the inserted position, the guide pins 114, 115 are located between the bearing journals 16 and the free end of the bending arm 13 of the spring operating lever. In the mid-position, the guide pins 114, 115 are located approximately above the bearing journals 16.

Figure 7:
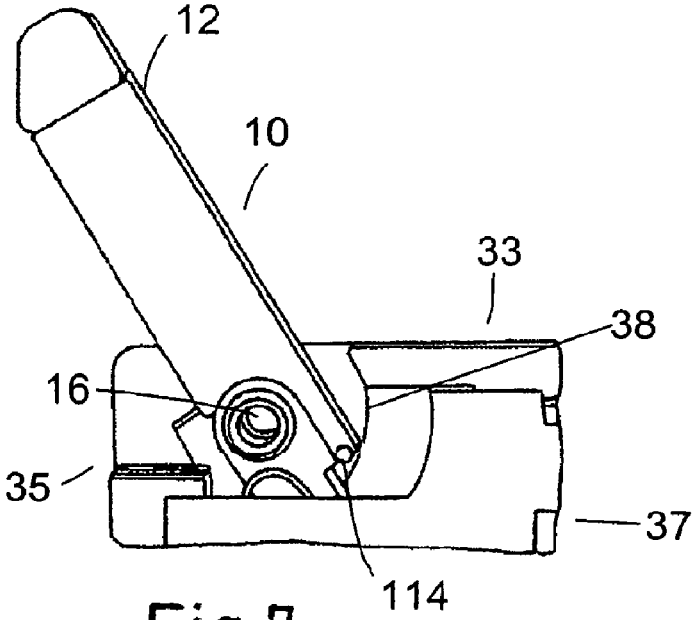
FIG. 7 shows the spring operating lever as shown in FIG. 6, in a partially pivoted position.

When the spring operating lever 10 pivots, the guide pins 114, 115 run in a guide groove 38 in the inner wall of the housing broad face, see FIG. 7. This additionally defines the movement path of the spring operating lever 10.

Figure 6:
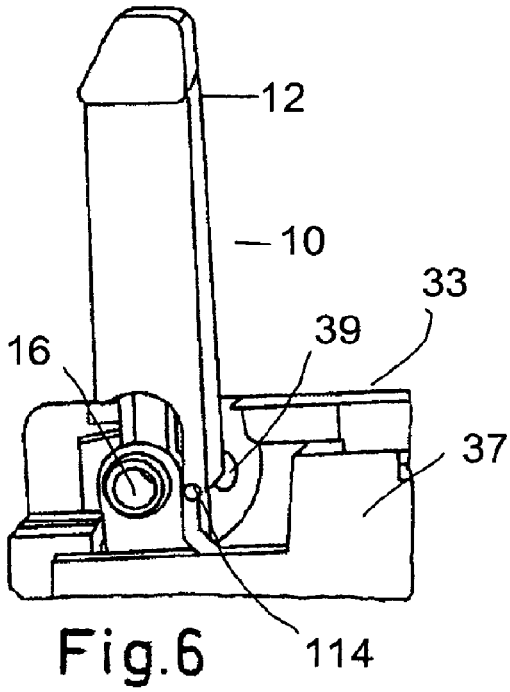
FIG. 6 shows the spring operating lever as shown in FIG. 5, with the housing partially open.

In the illustration shown in FIG. 7, the spring operating lever is located in the inserted position, and is illustrated in an intermediate position between the rest position and the open position. In the illustration shown in FIG. 6, the spring operating lever is shown in its open position, and is partially pulled out to its mid-position. In this position, the guide pins 114, 115 latch with a latching projection 39 which is fitted at an appropriately corresponding point at the side in the housing broad face. The spring operating lever 10 is therefore additionally locked in its open position, making it difficult for the terminal to be closed inadvertently. The spring operating lever cannot be pivoted back to its rest position again until it has been pushed from the mid-position to the inserted position again.

Figure 14:
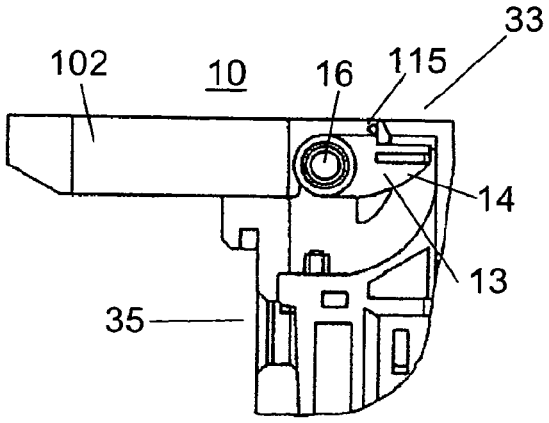
FIG. 14 shows a further embodiment of a spring operating lever, in its installed position in the terminal accommodation area of an installation switching device, in the retracted state and in its rest position.

The various operating and handling options for the spring operating lever are illustrated once again in FIGS. 14 to 21. FIG. 14 shows the spring operating lever 10 in its rest position, and the casing part 102 in its inserted position. The spring operating lever is aligned with the rearward front face 33 of the housing. The guide pin 115 is located to the right of the shaft 16.

Figure 15:
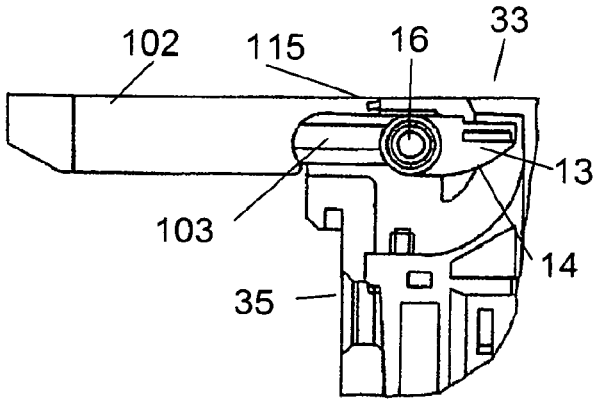
FIG. 15 shows a further embodiment of a spring operating lever, in its installed position in the terminal accommodation area of an installation switching device, in the extended state and in its rest position.

In FIG. 15, the casing part 102 has been pulled to its extended position, with the spring operating lever 10 in the rest position. The guide pin is now located to the left of the shaft 16. In this position, the lever arm of the operating arm has been lengthened.

Figure 16:
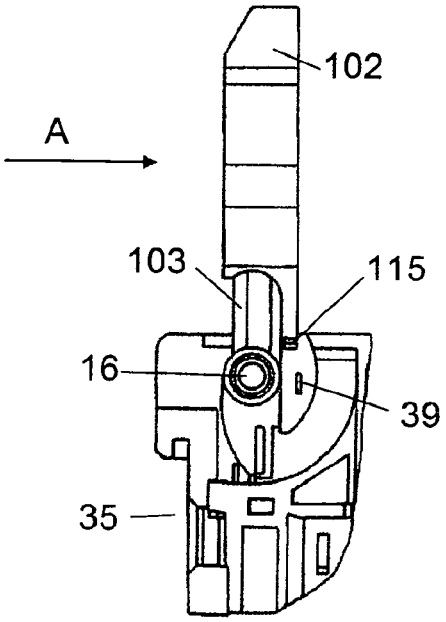
FIG. 16 shows the spring operating lever as shown in FIG. 15, in its open position.
Figure 17:
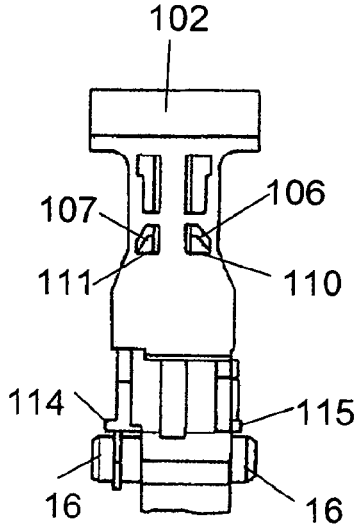
FIG. 17 shows the spring operating lever as shown in FIG. 16, seen in the direction of the arrow A.

FIG. 16 shows the position of the spring operating lever to which it has been moved by pivoting from the position shown in FIG. 15 to the open position. The guide pin 115 is now located above the shaft 16. It is free of the latching projection 39, as a result of which the spring operating lever 10 can be pivoted. FIG. 17 shows the view from the direction of the arrow A of the spring operating lever in the position shown in FIG. 16. The latching tabs 106, 107 are latched to the second undercuts 110, 111, thus making it more difficult to push the casing part 102 back inadvertently.

Figure 18:
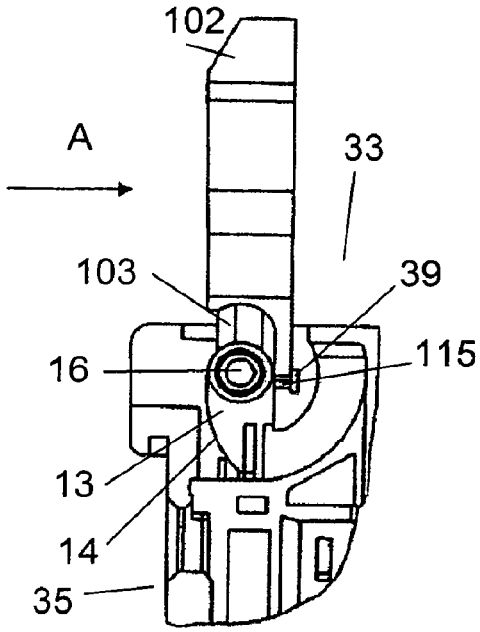
FIG. 18 shows the spring operating lever as shown in FIG. 16, partially inserted and locked in its open position.
Figure 19:
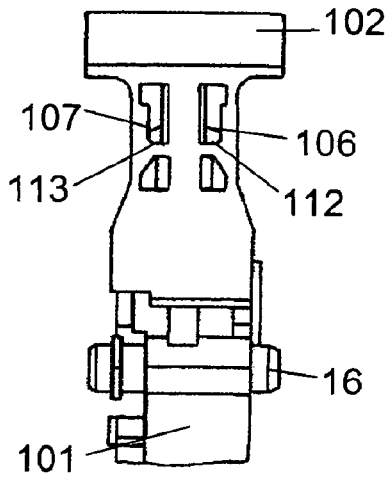
FIG. 19 shows the spring operating lever as shown in FIG. 18, seen in the direction of the arrow A.

In FIG. 18, the casing part has been partially retracted to its mid-position. In this position, the guide pin has been pushed behind the latching projection 39, and is held firmly by it. This blocks pivoting of the spring operating lever back to the rest position. FIG. 19 shows the view from the direction of the arrow A of the spring operating lever in the position shown in FIG. 18. The latching tabs 114, 115 have been latched to the third undercuts 112, 113, thus making it more difficult for the casing part 102 to be moved inadvertently from its mid-position.

Figure 20:
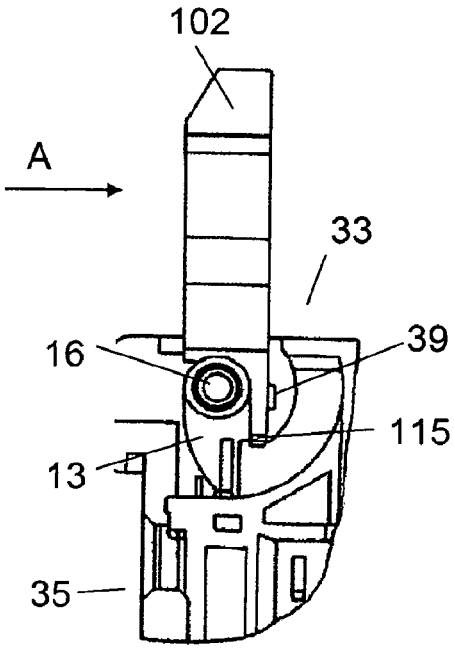
FIG. 20 shows the spring operating lever as shown in FIG. 18, inserted and unlocked in its open position.
Figure 21:
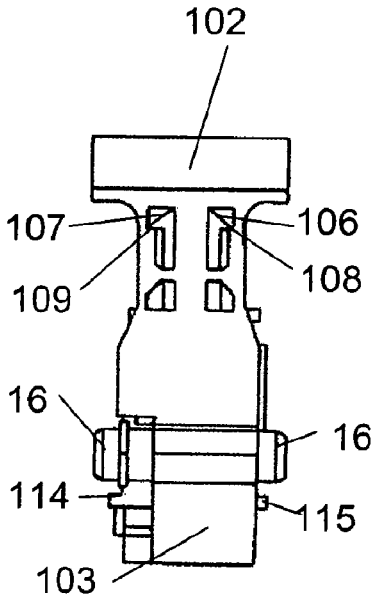
FIG. 21 shows the spring operating lever as shown in FIG. 20, seen in the direction of the arrow A.

In FIG. 20, the casing part has once again been pushed to its retracted position, with the spring operating lever 10 in the open position. The guide tabs 114, 115 have once again become free of the latching projection 39, and they are now located underneath the bearing journal 16, which forms the pivoting shaft. In this position, the spring operating lever can be pivoted back again to its rest position, as a result of which it would then once again assume the position shown in FIG. 14. FIG. 21 shows the view from the direction of the arrow A of the spring operating lever in the position shown in FIG. 20. The latching tabs 114, 115 have been latched to the first undercuts 106, 107, thus likewise making it more difficult for the casing part 102 to be moved inadvertently from its retracted position.

The installation switching device according to the invention therefore has various safety mechanisms for prevention of inadvertent operation of the spring operating lever. When the lever is positioned vertically and the terminal is therefore open, the casing part can be pushed in somewhat, as a consequence of which the guide pin latches and thus prevents the terminal from being closed inadvertently. Only when the casing part is moved out of its locking position again, or is pushed downward further, does the guide pin unlatch, allowing the terminal to close.

LIST OF REFERENCE SYMBOLS

10 Spring operating lever
11 Shaft of the spring operating lever
12 Operating arm
13 Bending arm
14 Contact surface
15 Flat
16 Bearing journal
17 Depression
20 Clamping spring
21 Contact limb
22 Busbar
23 Clamping strip
24 Clamping limb
25 Clamping window
26 Clamping edge
27 Spring rear
30 Installation switching device
31 Forward front face
32 Terminal accommodation area
33 Rearward front face
34 Forward narrow face lever
35 Rearward narrow face
36 Attachment face
37 Broad face
38 Guide groove
39 Latching projection
101 Core part
102 Casing part
103 Operating projection
104 Spring arm
105 Spring arm
106 Latching tab
107 Latching tab
108 First undercut
109 First undercut
110 Second undercut
111 Second undercut
112 Third undercut
113 Third undercut
114 Guide pin
115 Guide pin

The invention claimed is:

1. An installation switching device comprising:

a housing having a terminal connecting area and including a front face, and a narrow face;

a screwless spring-loaded terminal fixed in position in the terminal connecting area and including:

a clamping spring having a contact limb;

a clamping limb having a clamping window with a clamping edge; and a curved spring rear connecting the contact and clamping limbs and configured to interact with a mount part surrounding a clamping strip, such that a connecting conductor is clampable between a rear face of the clamping strip and the clamping edge; and a spring operating lever pivotably connected to the housing and configured to be operated outside the housing, the spring operating lever including a bending arm and an operating arm, the bending arm being configured to press on the spring rear when pivoting from a rest position to an open position so as to cause the clamping window to release a clamping opening on the rear face of the clamping strip for insertion of the connecting conductor and the operating arm, in the rest position, projecting outside along the insertion direction and at a right angle from the narrow face and being flush with the front face of the housing.

2. The installation switching device as recited in claim 1, wherein the spring operating lever is a double-armed lever with the operating arm projecting out of the housing and the bending arm guided in an interior of the housing.

3. The installation switching device as recited in claim 1, wherein the spring operating lever is configured to self-lock in the open position until it is pivoted by hand to the rest position.

4. The installation switching device as recited in claim 1, wherein the bending arm includes a contact surface disposed on a free end of the bending arm, the contact surface being in a form of a cam so as to cause the bending arm to roll on and press the spring rear during operation in an opening direction so as to cause a continuous opening process.

5. The installation switching device as recited in 1, further comprising a first guide device fitted to the spring operating lever; and a second guide device fitted to an interior of the housing, wherein the first and the second guide devices are configured to interact so as to guide the spring operating lever.

6. The installation switching device as recited in claim 5, further comprising a locking device fitted in the interior of the housing and configured to interact with the first guide device in the open position so as to prevent inadvertent pivoting of the spring operating lever from the open position to the rest position.

7. The installation switching device as recited in claim 5, wherein the second guide device is a curved groove, and the first guide device is a guide pin disposed on the spring operating lever.

8. The installation switching device as recited in claim 7, further comprising a locking contour disposed on an inner face of the housing in an area of the guide pin when the spring operating lever is in the open position, wherein the spring operating lever in the open position is movable in a direction of the locking contour, wherein the guide pin is coupled to the locking contour so as to prevent inadvertent pivoting of the spring operating lever from the open position to the rest position.

9. The installation switching device as recited in claim 8, wherein the locking contour is a web projecting on an inner wall of the housing.

10. The installation switching device as recited in claim 8, wherein the locking contour is an undercut.

11. An installation switching device comprising:

a housing having a terminal connecting area and including a front face, and a narrow face;

a screwless spring-loaded terminal fixed in position in the terminal connecting area and including:

a clamping spring having a contact limb;

a clamping limb having a clamping window with a clamping edge; and a curved spring rear connecting the contact and clamping limbs and configured to interact with a mount part surrounding a clamping strip, such that a connecting conductor is clampable between a rear face of the clamping strip and the clamping edge; and a spring operating lever pivotably connected to the housing and configured to be operated outside the housing, the spring operating lever including a bending arm and an operating arm, the bending arm being configured to press on the spring rear when pivoting from a rest position to an open position so as to cause the clamping window to release a clamping opening on the rear face of the clamping strip for insertion of the connecting conductor and the operating arm, in the rest position, projecting outside along the insertion direction and at a right angle from the narrow face and being flush with the front face of the housing, wherein the operating arm includes a first and a second arm element configured to be pushed one inside the other, wherein the operating arm can be lengthened by pulling out the second arm element relative to the first arm elements so as to achieve a greater lever force when pivoting.

* * * * *